US011767972B2

(12) United States Patent
Zhou et al.

(10) Patent No.: US 11,767,972 B2
(45) Date of Patent: Sep. 26, 2023

(54) CONCEALED OFFICE FAN LAMP

(71) Applicant: ZHONGSHAN FENGMEI LIGHTING & ELECTRICAL LTD, Zhongshan (CN)

(72) Inventors: Zuhong Zhou, Zhongshan (CN); Yi Liu, Zhongshan (CN)

(73) Assignee: ZHONGSHAN FENGMEI LIGHTING & ELECTRICAL LTD, Zhongshan (CN)

( * ) Notice: Subject to any disclaimer, the term of this patent is extended or adjusted under 35 U.S.C. 154(b) by 0 days.

(21) Appl. No.: 17/786,693

(22) PCT Filed: Dec. 27, 2019

(86) PCT No.: PCT/CN2019/129167
§ 371 (c)(1),
(2) Date: Jun. 17, 2022

(87) PCT Pub. No.: WO2021/120300
PCT Pub. Date: Jun. 24, 2021

(65) Prior Publication Data

US 2023/0016189 A1 Jan. 19, 2023

(30) Foreign Application Priority Data

Dec. 19, 2019 (CN) ..... 201922302335.X

(51) Int. Cl.
*F21V 33/00* (2006.01)
*F04D 25/06* (2006.01)
(Continued)

(52) U.S. Cl.
CPC ..... *F21V 33/0096* (2013.01); *F04D 25/06* (2013.01); *F04D 27/008* (2013.01); *F21S 8/06* (2013.01)

(58) Field of Classification Search
CPC .. F21V 33/0096; F21V 33/0088; F21V 33/00; F21V 23/00; F21V 23/0442;
(Continued)

(56) References Cited

U.S. PATENT DOCUMENTS 1,222,837 A * 4/1917 Winslow et al. ..... F21V 21/002 310/68 R
8,790,085 B2 * 7/2014 Villella ..... F21V 33/0096 416/223 R
(Continued)

FOREIGN PATENT DOCUMENTS

CN 201925187 U 8/2011
CN 105545778 A 5/2016
CN 205332022 U 6/2016

*Primary Examiner* — Bao Q Truong
(74) *Attorney, Agent, or Firm* — Bayramoglu Law Offices LLC

(57) ABSTRACT

A concealed office fan lamp is provided, which includes a stop device, a support and a fan blade. A lamp is arranged at the bottom of the support, a cavity is arranged in the support, the fan blade is electrically connected with a driving mechanism to make it rotatably arranged in the cavity, and the stop device is arranged on the support and/or the fan blade to detect the motion state of the fan blade. According to the motion state, the fan blade is stopped and hidden in the cavity. By providing a stop device on the fan lamp, the fan blade can be accurately stopped and hidden in the cavity, the person under the fan lamp cannot see the fan blade when the fan lamp stops working, making the fan lamp more beautiful as a whole.

8 Claims, 3 Drawing Sheets

(51) Int. Cl.
*F04D 27/00* (2006.01)
*F21S 8/06* (2006.01)

(58) Field of Classification Search
CPC ..... F04D 25/06; F04D 27/008; F04D 29/005; F04D 25/088; F21S 8/06; F21S 8/063; F05D 2260/903
See application file for complete search history.

(56) References Cited

U.S. PATENT DOCUMENTS

| | | | | |
|---|---|---|---|---|
| 9,696,026 | B1 * | 7/2017 | Hardgrave | F21V 5/06 |
| 2006/0128299 | A1 | 6/2006 | Wu | |
| 2008/0062643 | A1 * | 3/2008 | Mehta | F21V 33/0096 361/695 |
| 2014/0314571 | A1 * | 10/2014 | Wu | F21V 33/0096 416/5 |

* cited by examiner

CONCEALED OFFICE FAN LAMP

CROSS REFERENCE TO THE RELATED APPLICATIONS

This application is the national phase entry of International Application No. PCT/CN2019/129167, filed on Dec. 27, 2019, which is based upon and claims priority to Chinese Patent Application No. 201922302335.X, filed on Dec. 19, 2019, the entire contents of which are incorporated herein by reference.

TECHNICAL FIELD

The present disclosure relates to the technical field of fan lamp, in particular to a concealed office fan lamp.

BACKGROUND

Fan lamp, also known as luxury decorative ceiling fan, is mainly sold in foreign countries used as an auxiliary appliance of air conditioner to improve the use efficiency of air conditioner. The fan lamp has a beautiful appearance, which is equipped with fan blades and lights of different colors and styles, and has lighting, cooling, decoration and other functions. However, when the existing fan lamp is not working, the fan blades are generally exposed, which causes the appearance does not look beautiful enough. Although the fan blades of some fan lamps will be stored in the lamp body when they stop working, the structure is complex and the cost is high.

SUMMARY

With respect to the problems of the prior art, an object of the present disclosure is to provide a concealed office fan lamp.

To solve the above problems, the present disclosure adopts the following technical solution. A concealed office fan lamp includes a stop device, a support and a fan blade, wherein a lamp is arranged at the bottom of the support, a cavity is provided in the support, the fan blade is electrically connected with a driving mechanism so that it can be rotatably arranged in the cavity, and the stop device is arranged on the support and/or the fan blade to detect the motion state of the fan blade, and stop and hide the fan blade in the cavity according to the motion state.

As a further improvement of the present disclosure, the stop device includes a main control module, an electromagnet and a metal magnet. One of the electromagnet and the metal magnet is arranged in the cavity and the other is arranged on the fan blade. The main control module is electrically connected with the driving mechanism and the electromagnet respectively for providing a signal to the electromagnet to make the electromagnet work when the driving mechanism is powered off.

As a further improvement of the present disclosure, the stop module includes a main control module and a rotation speed sensor. The rotation speed sensor is arranged on the support or the fan blade to detect the speed of the fan blade. The main control module is electrically connected with the driving mechanism and the rotation speed sensor respectively, the main control module receives the speed information from the rotation speed sensor and controls the driving mechanism to rotate a further distance according to the speed information to stop and hide the fan blade in the cavity when the driving mechanism is powered off.

As a further improvement of the present disclosure, the support is provided as a rectangular support.

As a further improvement of the present disclosure, the driving mechanism is arranged directly above the rectangular support, the driving mechanism is wrapped with a box, and the box is provided with a connecting rod for connecting to the external ceiling.

As a further improvement of the present disclosure, the two ends of the rectangular support are provided with support rods for connecting the external ceiling to avoid the inclination of the rectangular support.

As a further improvement of the present disclosure, the driving mechanism is arranged as an AC (alternating current) motor or a DC (direct current) motor.

Advantageous Effects of the Present Disclosure

Compared with the prior art, the present disclosure has the following advantages:

By providing a stop device on the fan lamp, the fan blade can be accurately stopped and hidden in the cavity, the person under the fan lamp cannot see the fan blade when the fan lamp stops working, making the fan lamp more beautiful as a whole. Compared with the fan lamp in the prior art, the present disclosure can store the fan blade, the structure of which is simple and the production cost is low.

DETAILED DESCRIPTION OF THE EMBODIMENTS

The technical solution in the embodiment of the present disclosure will be clearly and completely described below in combination with the drawings in the embodiment of the present disclosure. It is apparent that the described embodiments are only part of the embodiments of the present disclosure, not all of them. Based on the embodiments of the present disclosure, all other embodiments obtained by those skilled in the art without making creative work belong to the scope of the present disclosure.

Figure 1:
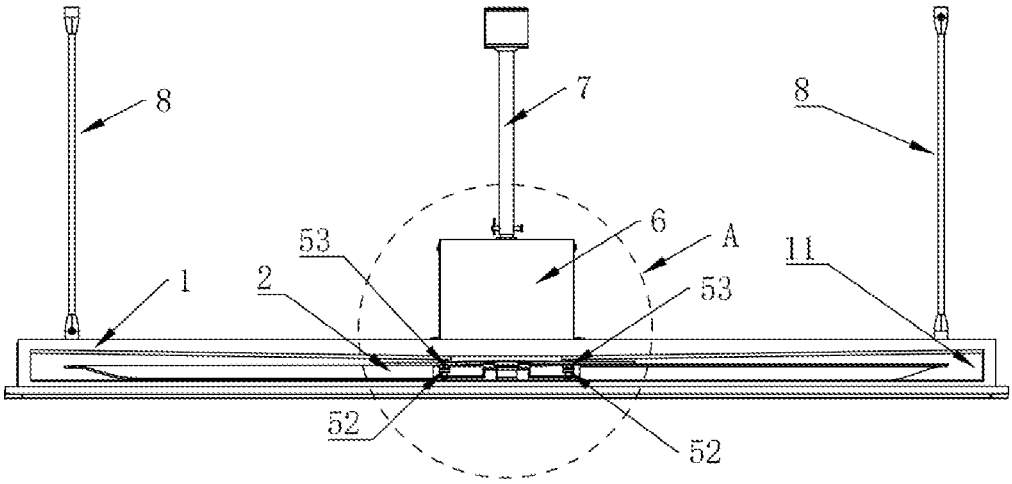
FIG. 1 is a structural diagram of the present disclosure.
Figure 2:
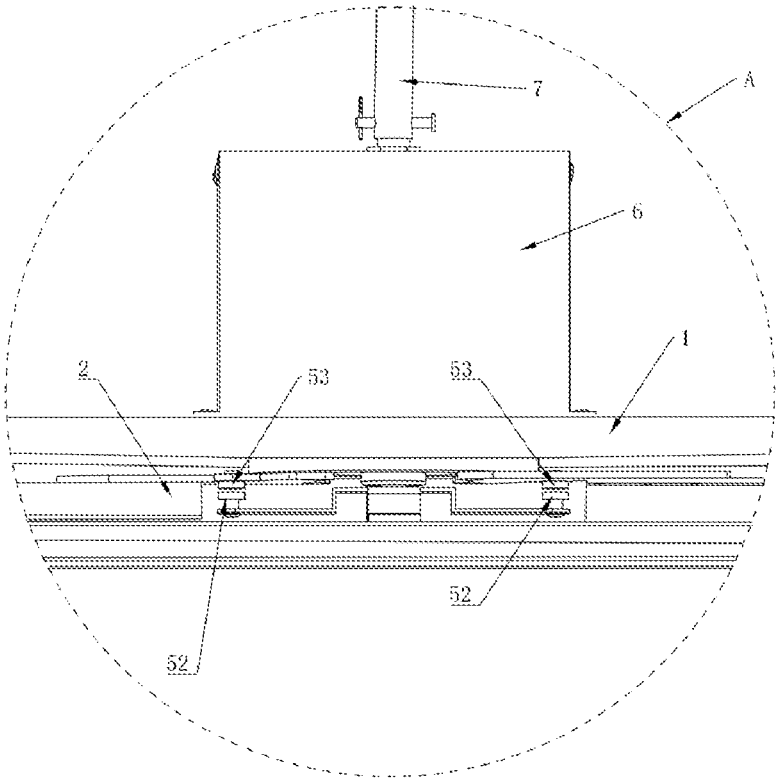
FIG. 2 is an enlarged structural diagram of area A in FIG. 1.
Figure 3:
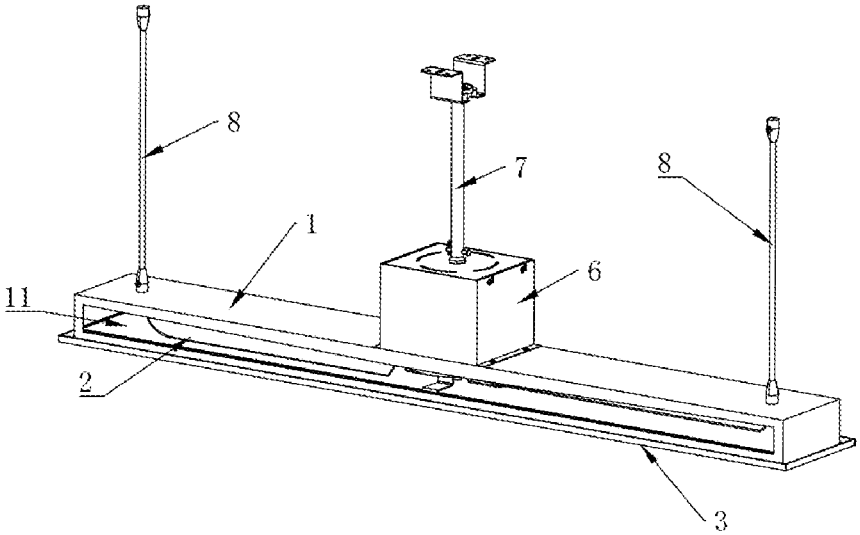
FIG. 3 is another structural diagram of the present disclosure.
Figure 4:
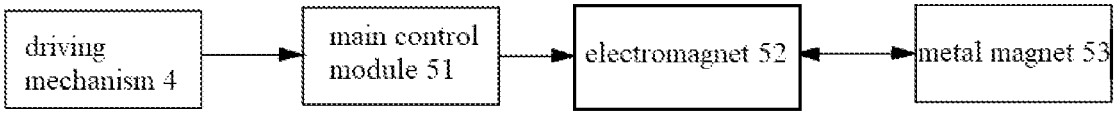
FIG. 4 is a support diagram showing of the principle of the present disclosure.
Figure 5:
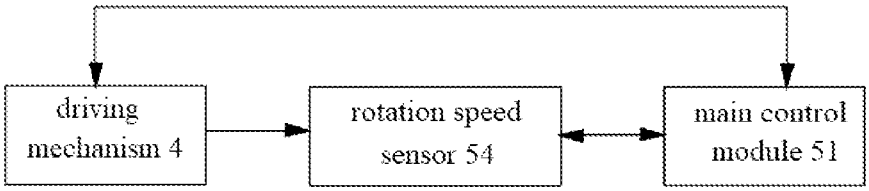
FIG. 5 is another support diagram showing of the principle of the present disclosure.
Figure 6:
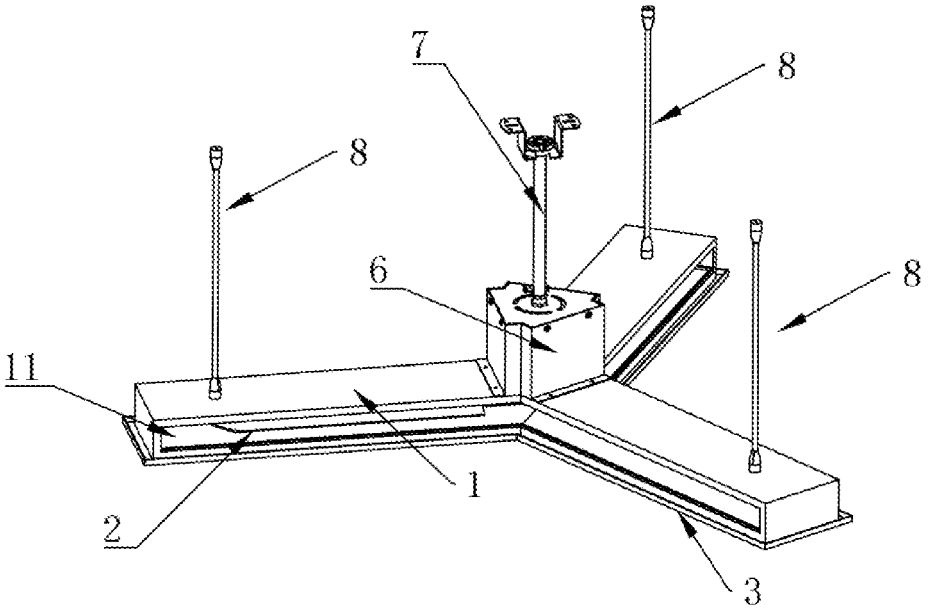
FIG. 6 is a structural diagram of another embodiment of FIG. 3.

Referring to FIG. 1 to FIG. 6, a concealed office fan lamp includes a stop device, a support 1 and a fan blade 2. A lamp 3 is arranged at the bottom of the support 1, a cavity 11 is arranged in the support 1, the fan blade 2 is electrically connected with a driving mechanism 4 so that it can be rotatably arranged in the cavity 11, and the stop device is arranged on the support 1 and/or the fan blade 2 to detect the motion state of the fan blade 2 The fan blade 2 is stopped and hidden in the cavity 11 according to the motion state. By providing a stop device on the fan lamp, the fan blade 2 can be accurately stopped and hidden in the cavity 11. The person under the fan lamp cannot see the fan blade 2 when the fan lamp stops working, making the fan lamp more beautiful as a whole. Compared with the prior art, the fan lamp provided by the present disclosure can store the fan blade 2 and has simpler structure and lower production cost.

Further, the stop device includes a main control module 51, an electromagnet 52 and a metal magnet 53. One of the electromagnet 52 and the metal magnet 53 is arranged in the cavity 11 and the other is arranged on the fan blade 2. The main control module 51 is electrically connected with the driving mechanism 4 and the electromagnet 52 respectively to make the electromagnet 52 work when the driving mechanism 4 is powered off and stops working.

The specific working principle is that when the driving mechanism 4 stops working, the electromagnet 52 gets the signal to power on and starts working. At this time, the electromagnet 52 and the metal magnet 53 attract each other. Due to the interaction of magnetic attraction, the fan blade 2 will finally stop inside the cavity 11. When the driving mechanism 4 starts working, the electromagnet 52 gets the signal to stop. There is no magnetic force between the electromagnet 52 and the metal magnet 53, such that the fan blade 2 rotates normally. The driving mechanism 4 may be an AC motor or a DC motor.

Further, the stop module includes a main control module 51 and a rotation speed sensor 54. The rotation speed sensor 54 is arranged on the support 1 or the fan blade 2 to detect the speed of the fan blade 2. The main control module 51 is electrically connected with the driving mechanism 4 and the rotation speed sensor 54 respectively, and the main control module 51 receives the speed information from the rotation speed sensor 54 and controls the driving mechanism 4 to rotate a further distance according to the speed information to stop and hide the fan blade 2 in the cavity 11 when the driving mechanism 4 is powered off.

The specific working principle is that when the driving mechanism 4 is powered off and stops working, the fan blade 2 still keeps rotating, and the speed is getting lower and lower. When the rotation speed sensor 54 detects that the speed reaches the preset threshold, the main control module 51 sends a control signal to the driving mechanism 4 to make the driving mechanism 4 further rotate a certain fixed angle, and then the fan blade 2 stops and hides in the cavity 11. When the driving mechanism 4 starts working, the rotation speed sensor 54 receives a signal to stop working, and the fan blade 2 rotates normally. The driving mechanism 4 can be a stepper motor. The speed and stop position of the stepper motor only depend on the frequency and the number of pulses of the pulse signal, not affected by the load change. When a stepper driver receives a pulse signal, it drives the stepper motor to rotate a certain fixed angle in the preset direction, which is called "step angle". Its rotation runs step by step at a fixed angle. The angular displacement can be controlled by controlling the number of pulses, so as to achieve the purpose of accurate positioning.

Preferably, the support 1 is arranged as a rectangular support. The rectangular support is more suitable for the blade 2 hiding. In the present disclosure, the rectangular supports can be set as two on the same straight line, or as three forming an angle of 120 degrees with each other, and the number of rectangular supports is not limited.

The driving mechanism 4 is arranged directly above the rectangular support, the driving mechanism 4 is wrapped with a box 6, and the box 6 is provided with a connecting rod 7 for connecting to the external ceiling.

The two ends of the rectangular support 1 are provided with support rods 8 for connecting the external ceiling to avoid inclination of the rectangular support 1.

The above description is only a preferred embodiment of the present disclosure, however, the scope of the present disclosure is not limited to this. It can be understood by the skilled person in the art that any equivalent replacement or modification made based on technical solution and improved concept of the present disclosure shall be fall into the scope of the present disclosure.

What is claimed is:

1. A concealed office fan lamp, comprising a stop device, a support and a fan blade, wherein a lamp is arranged at a bottom of the support, a cavity is provided in the support, the fan blade is electrically connected with a driving mechanism and is rotatably arranged in the cavity; and the stop device is arranged on the support and/or the fan blade to detect a motion state of the fan blade and stop and hide the fan blade in the cavity according to the motion state.

2. The concealed office fan lamp according to claim 1, wherein the stop device comprises a main control module, an electromagnet and a metal magnet, one of the electromagnet and the metal magnet is arranged in the cavity and the other of the electromagnet and the metal magnet is arranged on the fan blade, and the main control module is electrically connected with the driving mechanism and the electromagnet respectively for providing a signal to the electromagnet to make the electromagnet work when the driving mechanism is powered off.

3. The concealed office fan lamp according to claim 1, wherein the stop device comprises a main control module and a rotation speed sensor, the rotation speed sensor is arranged on the support or the fan blade to detect a speed of the fan blade, the main control module is electrically connected with the driving mechanism and the rotation speed sensor respectively, and the main control module receives speed information from the rotation speed sensor and controls the driving mechanism to rotate a distance according to the speed information to stop and hide the fan blade in the cavity when the driving mechanism is powered off.

4. The concealed office fan lamp according to claim 1, wherein the support is provided as a rectangular support.

5. The concealed office fan lamp according to claim 4, wherein the driving mechanism is arranged directly above the rectangular support, the driving mechanism is wrapped with a box, and the box is provided with a connecting rod for connecting the concealed office fan lamp to an external ceiling.

6. The concealed office fan lamp according to claim 4, wherein two ends of the rectangular support are provided with support rods for connecting an external ceiling to avoid an inclination of the rectangular support.

7. The concealed office fan lamp according to claim 1, wherein the driving mechanism is arranged as an AC motor or a DC motor.

8. The concealed office fan lamp according to claim 5, wherein two ends of the rectangular support are provided with support rods for connecting the external ceiling to avoid an inclination of the rectangular support.

* * * * *